US009496643B2

(12) United States Patent
Kato et al.

(10) Patent No.: US 9,496,643 B2
(45) Date of Patent: Nov. 15, 2016

(54) CONNECTOR

(71) Applicant: YAZAKI CORPORATION, Tokyo (JP)

(72) Inventors: Hajime Kato, Shizuoka (JP); Hiroaki Imai, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/054,344

(22) Filed: Feb. 26, 2016

(65) Prior Publication Data

US 2016/0181727 A1 Jun. 23, 2016

Related U.S. Application Data

(63) Continuation of application No. PCT/JP2014/075469, filed on Sep. 25, 2014.

(30) Foreign Application Priority Data

Oct. 4, 2013 (JP) ..... 2013-209683

(51) Int. Cl.
*H01R 13/623* (2006.01)
*H01R 13/502* (2006.01)
*H01R 13/629* (2006.01)

(52) U.S. Cl.
CPC ..... *H01R 13/623* (2013.01); *H01R 13/502* (2013.01); *H01R 13/629* (2013.01)

(58) Field of Classification Search
CPC ..... H01R 13/62938; H01R 13/62955; H01R 13/62905; H01R 13/62916
USPC ..... 439/157
See application file for complete search history.

(56) References Cited

U.S. PATENT DOCUMENTS 5,110,301 A * 5/1992 Inoue ..... H01R 13/62944 403/322.1
5,171,156 A * 12/1992 Nagasaka ..... H01R 13/62938 439/157

(Continued)

FOREIGN PATENT DOCUMENTS

JP 4-363879 A 12/1992
JP 2002-280117 A 9/2002

(Continued)

OTHER PUBLICATIONS

International Search Report of PCT/JP2014/075469, dated Nov. 4, 2014. [PCT/ISA/210].

(Continued)

*Primary Examiner* — Gary Paumen
(74) *Attorney, Agent, or Firm* — Sughrue Mion, PLLC

(57) ABSTRACT

A connector includes a female terminal having an elastically deformable contact portion; a housing; a rotary cylinder rotatably mounted to the housing; and a slider movably mounted in a cylinder axis direction via a motion direction converting mechanism, in which the motion direction converting mechanism is configured to move the slider from a first cylinder axis position to a second cylinder axis position when the rotary cylinder is rotated from a first rotation position to a second rotation position, the slider is formed to be separated from a contact portion at the first cylinder axis position and press the contact portion at the second cylinder axis position, and the contact portion of the female terminal is formed to come into pressing contact with the male terminal by being pressed by the slider.

6 Claims, 6 Drawing Sheets

(56) References Cited

U.S. PATENT DOCUMENTS 6,164,991 A * 12/2000 Matsuura ..... H01R 13/6275 439/157
6,193,530 B1 * 2/2001 Sakurai ..... H01R 13/62905 439/153
6,210,184 B1 * 4/2001 Kodama ..... H01R 13/621 439/157
8,747,130 B2 * 6/2014 Tyler ..... H01R 13/62938 439/157
8,939,783 B2 * 1/2015 Pfeiffer ..... H01R 13/6273 439/314
8,971,051 B2 * 3/2015 Liang ..... H05K 7/1402 361/736
2012/0058656 A1 * 3/2012 Littek ..... H01R 13/62922 439/157

FOREIGN PATENT DOCUMENTS

JP 2003-51357 A 2/2003
JP 2010-267451 A 11/2010

OTHER PUBLICATIONS

Written Opinion of PCT/JP2014/075469, dated Nov. 4, 2014. [PCT/ISA/237].

* cited by examiner

CONNECTOR

CROSS-REFERENCE TO RELATED APPLICATION

This application is a continuation application of International Application PCT/JP2014/075469, filed on Sep. 25, 2014, and designating the U.S., the entire contents of which are incorporated herein by reference.

BACKGROUND OF THE INVENTION

1. Field of the Invention

The present invention relates to a connector which electrically connects terminals to each other, and more particularly, to a zero insertion force (ZIF) connector which connects a female terminal to a male terminal without requiring an excessive load during insertion of the male terminal into the female terminal.

2. Description of the Related Art

In a so-called ZIF connector, after a male terminal is inserted into a female terminal accommodated in an accommodation portion in a contactless state, the terminals are moved relative to each other as a movable portion is moved relative to the accommodation portion so as to cause the terminals to come into contact with each other. Accordingly, in the ZIF connector, it is possible to electrically, easily, and reliably connect the terminals to each other while reducing load in the stage of the insertion of the male terminal into the female terminal.

In Japanese Patent Application Laid-open No. 2003-51357, a configuration of the ZIF connector is exemplified. The connector disclosed in Japanese Patent Application Laid-open No. 2003-51357 has a configuration in which a bar-like sliding body is moved relative to the accommodation portion (insulator) as the movable portion (slider) is moved such that the male terminal (pin), which is preliminarily inserted into the female terminal (contact), and the female terminal are brought into contact with each other. The female terminal is accommodated in the insulator. In the connector, the bar-like sliding body is disposed in the lower portion of the female terminal. In addition, the slider is provided with a groove portion (cam groove) with which both ends of the bar-like sliding body are engaged. Accordingly, in the connector, when the slider is moved, the bar-like sliding body moves along the cam groove and presses the female terminal such that the female terminal and the male terminal are brought into contact with each other.

In the connector disclosed in Japanese Patent Application Laid-open No. 2003-51357, the female terminal and the male terminal are brought into contact with each other by lifting the bar like sliding body along the movement of the slider. Specifically, in the configuration, by moving the slider in a direction (horizontal direction) perpendicular to the direction of insertion (downward direction of upward and downward directions) of the male terminal into the female terminal, the bar-like sliding body is moved. (lifted) along the cam groove. That is, in the connector, the slider needs to undergo parallel movement (linearly along the horizontal direction) perpendicularly to the insertion direction of the terminal.

Therefore, in the connector, a distance (dimension) by which the slider undergoes parallel movement has to be ensured to be perpendicular to the insertion direction of the terminal, and the size is increased by the movement amount of the slider. Therefore, in the connector of the related art, there is room for improvement in achieving a reduction in the size or weight of, for example, an electric device in which the connector is mounted.

SUMMARY OF THE INVENTION

In view of the circumstances described above, the present invention aims to provide a connector which simultaneously achieves a reduction in a terminal insertion load and a reduction in size, and increases mountability on a device.

To achieve the above-described objective, a connector according to one aspect of the present invention includes a female terminal having an elastically deformable contact portion; a housing in which the female terminal is accommodated; a rotary cylinder configured to be rotatably mounted to the housing; and a slider configured to be movably mounted in a cylinder axis direction of the rotary cylinder via a motion direction converting mechanism which converts rotary motion of the rotary cylinder about a cylinder axis into linear motion in the cylinder axis direction of the rotary cylinder, wherein the motion direction converting mechanism is configured to move the slider from a first cylinder axis position to a second cylinder axis position when the rotary cylinder is rotated from a first rotation position to a second rotation position, the slider is formed to be separated from the contact portion of the female terminal at the first cylinder axis position and is formed to press the contact portion of the female terminal at the second cylinder axis position, and the contact portion of the female terminal is positioned to face the male terminal inserted into the housing and is formed to come into pressing contact with the male terminal by being pressed by the slider.

Accordingly, in the connector, since the male terminal inserted into the housing does not come into contact with the female terminal, the insertion load of the male terminal in the stage of insertion into the housing can be reduced. Furthermore, after the insertion, only by rotating the rotary cylinder from the first rotation position to the second rotation position, the contact portion of the female terminal can be brought into pressing contact with the male terminal, and thus the terminals can be electrically connected to each other.

That is, in the connector according to the present invention, rotary motion of the rotary cylinder about the cylinder axis is converted into linear reciprocating motion of the slider along the cylinder axis direction by the motion direction converting mechanism. As an example, the motion direction converting mechanism, includes at least one protrusion which is formed on one of an inner cylindrical surface of the rotary cylinder and an outer peripheral surface of the slider, and at least one spiral groove which is formed on the other and engages with the protrusion. Accordingly, when the rotary cylinder is rotated about the cylinder axis from the first rotation position to the second rotation position, the protrusion relatively moves along the spiral groove to make the slider to move from the first cylinder axis position to the second cylinder axis position, the slider presses the contact portion to make the contact portion to come into contact with the male terminal and thus can electrically connect the terminals to each other. On the other hand, when the rotary cylinder is rotated about the cylinder axis from the second rotation position to the first rotation position, the protrusion relatively moves along the spiral groove to make the slider to retreat from the second cylinder axis position to the first cylinder axis position, the slider is separated from the contact portion and releases the pressure to allow the contact portion and the male terminal to be maintained in a non-contact states such that the electrical connection between the terminals can be released.

In this case, the spiral groove includes a track groove in which the protrusion relatively moves along the cylinder axis direction, and two restriction grooves which are respectively provided at both ends of the track groove to restrict the relative movement of the protrusion in the cylinder axis direction. In addition, it is desirable that the restriction grooves are grooves that are parallel to a circumferential direction of the rotary cylinder or the slider and communicate with end portions of the track groove. Accordingly, the connector restricts further movement of the protrusion that relatively moves along the spiral groove, and thus can suppress the movement of the slider in the cylinder axis direction with respect to the rotary cylinder.

In addition, the connector according to the present invention can be configured to be provided with an operation member which is mounted on the rotary cylinder and moves along an outer surface of the housing to rotate the rotary cylinder about the cylinder axis. Accordingly, in the connector the rotary cylinder can be easily rotated about the cylinder axis only by moving the operation member along the outer surface of the housing.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
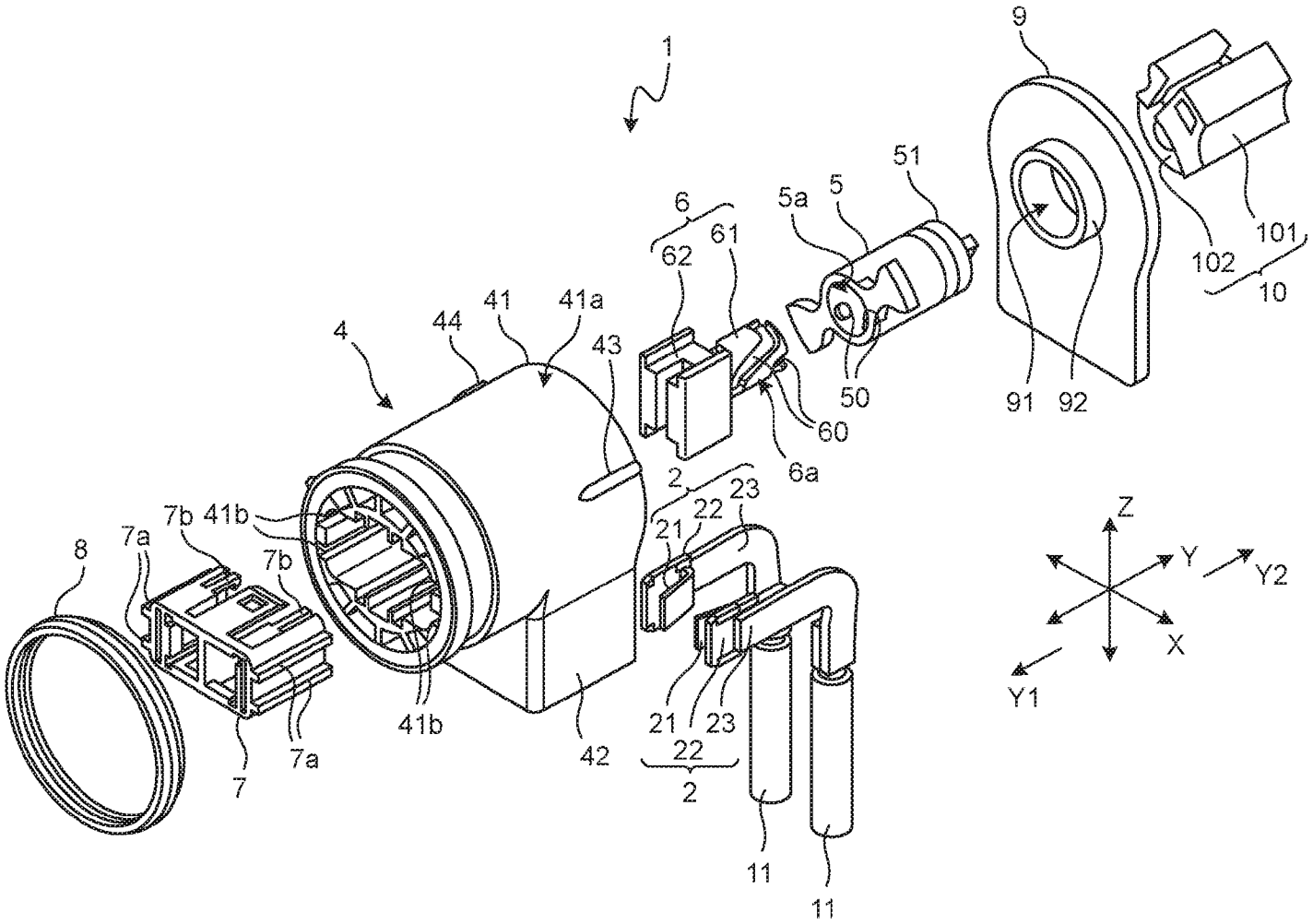
FIG. 1 is a perspective view illustrating a connector according to an embodiment of the present invention, which is disassembled into constituent members.
Figure 2:
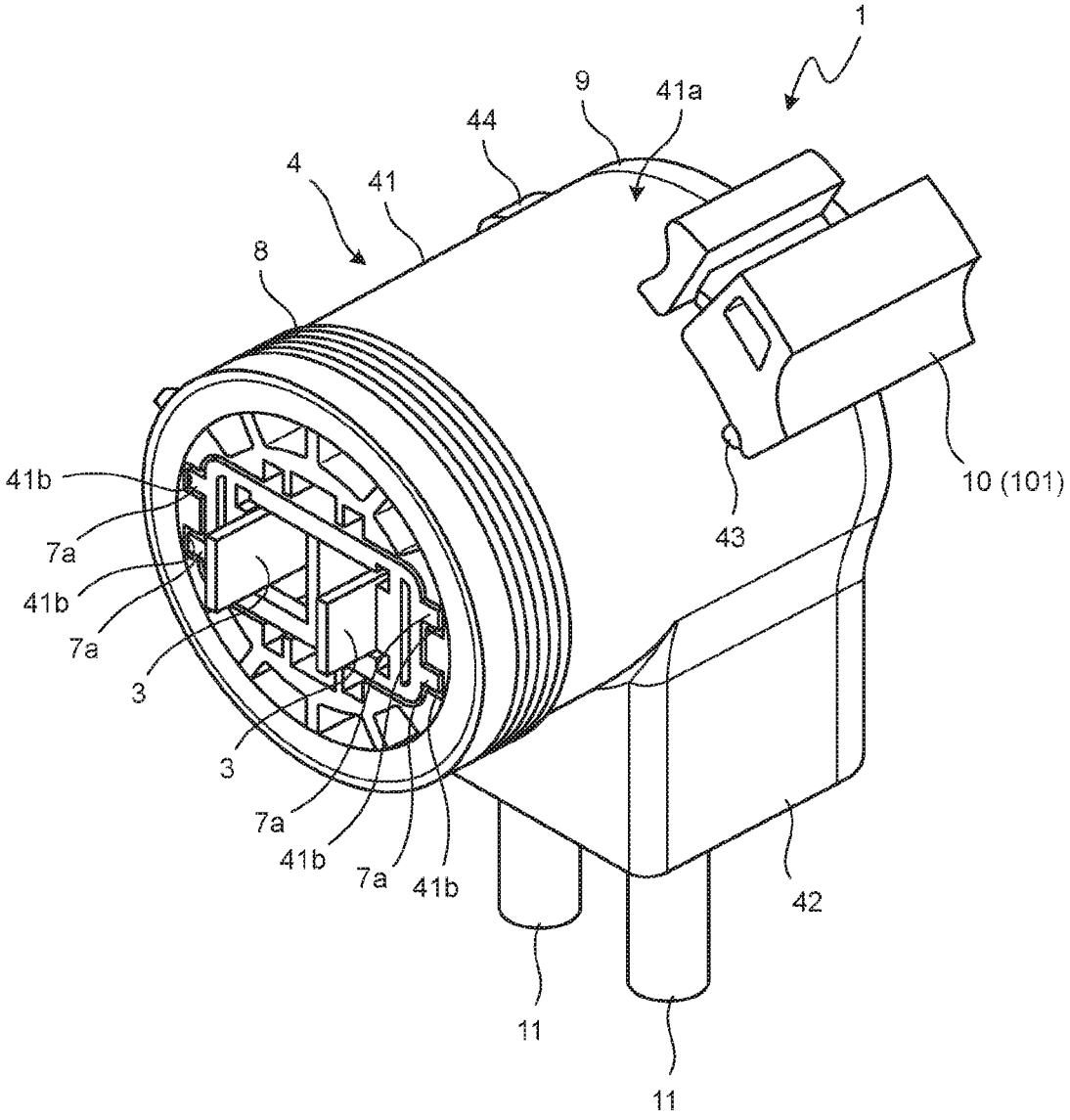
FIG. 2 is an overall perspective view of the connector, illustrating a state in which the constituent members illustrated in FIG. 1 are assembled together.

Hereinafter, a connector of the present invention will be described with reference to the accompanying drawings. FIGS. 1 and 2 illustrate the overall configuration of a connector according to an embodiment of the present invention. FIG. 1 is a perspective view illustrating the connector disassembled into constituent members. FIG. 2 is an overall perspective view illustrating a state in which the constituent members illustrated in FIG. 1 are assembled together. In the following description, an arrow X direction illustrated in FIG. 1 is referred to as leftward and rightward directions, an arrow Y direction is referred to as forward and rearward directions, and an arrow Z direction is referred to as upward and downward directions. Regarding the forward and rearward directions, an arrow Y1 direction in FIG. 1 is specified as the forward side (front side), and an arrow Y2 direction is specified as the rearward side (rear side). However, the leftward and rightward directions, the forward and rearward directions, and the upward and downward directions are not necessarily coincident with the corresponding directions in a state in which the connector is actually connected to a mating device.

As illustrated in FIG. 1, a connector 1 includes female terminals 2 having contact portions 21 which are elastically deformable, a housing 4 in which the female terminal 2 is accommodated, a rotary cylinder 5 which is rotatably mounted to the housing 4, and a slider 6 which is movably mounted in a cylinder axis direction of the rotary cylinder 5 via a motion direction converting mechanism which converts rotary motion of the rotary cylinder 5 into linear motion. In addition, the connector 1 includes an operation member (hereinafter, referred to as lever) 10 which is mounted on the rotary cylinder 5 and moves along an outer surface 41*a* of the housing 4 to rotate the rotary cylinder 5 about the cylinder axis. In addition, the cylinder axis direction of the rotary cylinder 5 corresponds to the forward and rearward directions.

FIG. 1 illustrates a configuration of the connector 1 provided with the two female terminals 2 which are respectively attached to the terminal portions of two electrical wires 11. However, the number of female terminals 2 is not particularly limited. For example, the connector 1 may have a connector configuration provided with a single female terminal 2 or may have a connector configuration provided with three or more female terminals 2. In addition, in FIG. 1, the female terminal 2 is configured to be attached to the terminal portion of the electrical wire 11. However, the female terminal 2 may also be configured to be directly attached to the contact or the like of a circuit board. The point is that the female terminal may be configured as an interface that is electrically connected to the mating device provided with a male terminal 3 (FIG. 2). In other words, the number of male terminals 3 is not limited as long as it corresponds to the number of female terminals 2, and the male terminal 3 may be configured as an interface that is electrically connected to an electric device having the connector 1 mounted therein via the female terminal 2.

The female terminal 2 is configured to include the contact portions 21 which are formed of a conductive metallic material and are electrically connected to the male terminal 3 by being elastically deformed, contact support portions 22 which support the contact portions 21, and electrical wire joint portions 23 which are connected to the contact support portion 22 and are joined to the terminal portions of the electrical wires 11. The contact portion 21 can be elastically deformed (bending deformation) in the leftward and rightward directions with respect to the contact support portion 22 from a support portion supported by the contact support portion 22 in a gap between the contact portion 21 and the contact support portion 22 as the bending margin. The electrical wire joint portion 23 has a flat plate shape bent substantially at right angle, one end thereof is directed toward the front side and is connected to the contact support portion 22, and the other end thereof is directed to the downward side and is joined to the terminal portion of the electrical wire 11. That is, in this embodiment, the connector 1 is configured to have a bent shape (so-called L-shape) in which the mating device having the male terminal 3 is connected to the electrical wire 11, to which the female terminal 2 is attached, substantially at right angle. However, the connector 1 may also be configured to have a straight shape in which the electrical wire 11 and the mating device are connected along the extension direction of the electrical wire 11.

The housing 4 is configured to have a terminal accommodation portion 41 having a substantially cylindrical shape, an electrical wire accommodation portion 42 which protrudes downward from the outer periphery of the terminal accommodation portion 41 in a substantially rectangular box shape. The terminal accommodation portion 41 has openings on both sides in the forward and rearward directions, respectively, holds the male terminal 3 inserted from the front side, and holds the female terminal 2 inserted from the rearward side. The electrical wire accommodation portion 42 has openings on the rear side and downward side, respectively, the electrical wire 11 is accommodated from the opening on the rear side in a state where the female terminal 2 is held in the terminal accommodation portion 41, and the accommodated electrical wire 11 extends from the opening on the downward side toward the outside. In the housing 4, a terminal holder 7 can be positioned on the front side of the rotary cylinder 5 and the slider 6 in the cylinder of the terminal accommodation portion 41 and can be mounted. The two female terminals 2 inserted into the housing 4 are held in the terminal holder 7 while the contact portions 21 are adjacent to each other in the leftward and rightward directions with a predetermined interval therebetween. In this case, mounting grooves 41*b* and engagement portions are formed in the terminal accommodation portion 41, and mounting protrusions 7*a* to be fitted in the mounting grooves 41*b* and engagement pieces 7*b* to be engaged with the engagement portions are formed in the terminal holder 7. Accordingly, in the connector 1, by engaging the engagement pieces 7*b* with the engagement portions while allowing the mounting protrusions 7*a* to be fitted in the mounting grooves 41*b* from the forward opening of the terminal accommodation portion 41, the terminal holder 7 can be positioned and fixed to the housing 4. That is, the female terminal 2 is held by the housing 4 on the forward side of the rotary cylinder 5 and the slider 6 via the terminal holder 7, which is positioned and fixed to the housing 4.

The male terminals 3 are inserted respectively into gaps between the contact portions 21 and the contact support portions 22 of the female terminals 2 in advance, the gaps being on the inside of the two female terminals 2 held in the housing 4 in the leftward and rightward directions. In the gaps on the inside, the male terminal 3 is held such that male terminal 3 faces the female terminal 2 in the terminal holder 7. As described above, when the male terminal 3 is inserted into the housing 4 (terminal accommodation portion 41) from the forward opening so as to be held in the terminal holder 7, the male terminal 3 does not come into contact with the contact portion 21 of the female terminal 2 (even when they come into contact with each other, an excessive insertion load is not generated). Therefore, in the connector 1, the male terminal 3 can be smoothly inserted into the cylinder of the housing 4 (the terminal holder 7) without requiring an excessive load. In addition, the female terminal 2 and the inserted male terminal 3 are held in the terminal holder 7 in a state of facing each other without contacts.

In addition, an annular sealing member (as an example, a seal formed of rubber with an elastic lip) 8 is attached to the outer periphery of the forward side of the housing 4. The sealing member 8 achieves sealing (water-proof or dust-proof performance) when the mating device having the male terminal 3 is fitted with the connector 1. In addition, a cover member (hereinafter, referred to as a rear cover) 9 is mounted on the rear side of the housing 4. The cover member 9 blocks each of the rear openings of the terminal accommodation portion 41 and the electrical wire accommodation portion 42, and seals the female terminals 2 and the terminal holder 7 accommodated and held in the housing 4, the rotary cylinder 5, and the slider 6 from the outside.

The rotary cylinder 5 and the slider 6 are formed so that the slider 6 moves in the cylinder axis direction with respect to the rotary cylinder 5 when the rotary cylinder 5 is rotated about the cylinder axis. That is, the rotary cylinder 5 and the slider 6 operate as the motion direction converting mechanism which converts motion direction. The motion direction converting mechanism converts the rotary motion of the rotary cylinder 5 about the cylinder axis into linear reciprocating motion of the slider 6 along the cylinder axis direction.

Specifically, the motion direction converting mechanism moves the slider 6 in the cylinder axis direction from a first cylinder axis position to a second cylinder axis position when the rotary cylinder 5 is rotated about the cylinder axis from a first rotation position to a second rotation position. In this case, the first rotation position and the first cylinder axis position are set to a position at which the slider 6 allows the female terminal 2 (simply, the contact portion 21) not to be pressed against the male terminal 3 and thus allows the female terminal 2 to be separated from and face the male terminal 3. In addition, the second rotation position and the second cylinder axis position are set to a position at which the slider 6 presses the female terminal 2 (simply, the contact portion 21) against the male terminal 3 and thus makes the female terminal 2 to be electrically connected to the male terminal 3. In other words, the slider 6 is formed to be separated from the contact portion 21 of the female terminal 2 at the first cylinder axis position and is formed to press the contact portion 21 of the female terminal 2 at the second cylinder axis position. In addition, the contact portion 21 of the female terminal 2 is positioned to face the male terminal 3 inserted into the housing 4 and is formed to come into pressing contact with the male terminal 3 by being pressed by the slider 6. Accordingly, when the rotary cylinder 5 is rotated about the cylinder axis from the first rotation position to the second rotation position, the slider 6 moves from the first cylinder axis position to the second cylinder axis position and pressures the female terminal 2 against the male terminal 3 to make the female terminal 2 to be electrically connected to the male terminal 3. Conversely, when the rotary cylinder 5 is rotated about the cylinder axis from the second rotation position to the first rotation position, the slider 6 moves from the second cylinder axis position to the first cylinder axis position and allows the female terminal 2 to be separated from the male terminal 3 so as to release the electrical connection to the male terminal 3.

Therefore, in a stage in which the male terminal 3 is inserted into the housing 4 in a state where the rotary cylinder 5 is positioned at the first rotation position (corresponding to a state in which the slider 6 is positioned at the first cylinder axis position), the slider 6 does not press the female terminal 2 against the male terminal 3, and the female terminal 2 and the male terminal 3 are held in the terminal holder 7 in a state of facing each other. Therefore, in the connector 1, since the male terminal 3 inserted into the housing 4 does not come into contact with the female terminal 2, the insertion load of the male terminal 3 in the stage of insertion into the housing 4 can be reduced. Furthermore, after the insertion, only by rotating the rotary cylinder 5 from the first rotation position to the second rotation position (moving the slider 6 from the first cylinder axis position to the second cylinder axis position), the male terminal 3 can be electrically connected to the female terminal 2 with ease.

As an example of the motion direction converting mechanism, at least one protrusion may be formed on one of an inner cylindrical surface 5*a* of the rotary cylinder 5 and an outer peripheral surface 6*a* of the slider 6, and at least one spiral groove which engages with the protrusion may be formed on the other. Due to the protrusion and the spiral groove, when the rotary cylinder 5 is rotated about the cylinder axis from the first rotation position to the second rotation position (hereinafter, forward rotation), the protrusion relatively moves along the spiral groove to make the slider 6 to move from the first cylinder axis position to the second cylinder axis position, and the slider 6 presses the contact portion 21 with a pressing portion 62, which will be described later, so as to elastically deform the contact portion 21. On the other hand, when the rotary cylinder 5 is rotated about the cylinder axis from the second rotation position to the first rotation position (hereinafter, reverse rotation), the protrusion relatively moves along the spiral groove to make the slider 6 to retreat from the second cylinder axis position to the first cylinder axis position, and the slider 6 separates the pressing portion 62 from the contact portion 21 so as to elastically restore the contact portion 21.

Figure 3:
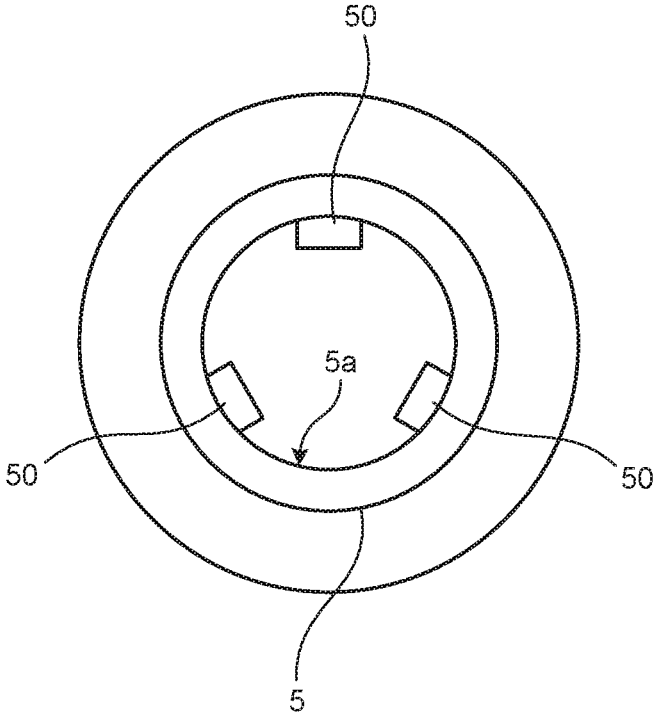
FIG. 3 is a schematic view illustrating the arrangement of three protrusions formed on the inner cylindrical surface of a rotary cylinder.

As illustrated in FIG. 1, this embodiment employs a configuration in which a protrusion 50 is formed on the inner cylindrical surface 5*a* of the rotary cylinder 5, and a spiral groove (so-called screw groove) 60 is formed on the outer peripheral surface 6*a* of the slider 6. Specifically, in this embodiment, as illustrated in FIG. 3, three protrusions 50 are formed in the rotary cylinder 5, and three spiral grooves 60, which respectively engage with the protrusions 50, are formed in the slider 6. However, the number of protrusions 50 and the number of spiral grooves 60 may be two or less, or four or more as long as the numbers are equal to each other.

FIG. 3 illustrates an arrangement example of the three protrusions 50 formed on the inner cylindrical surface 5*a* of the rotary cylinder 5. In this case, the protrusions 50 having the same shape are arranged at equal intervals (a phase difference of 120□) on the same circumference in the forward and rearward directions in the inner cylindrical surface 5*a*. As an example, in FIG. 1, the protrusion 50 is formed in a columnar shape. However, the shape is not particularly limited, and may also be, for example, an elliptical column shape, a prism shape, or a truncated cone shape. In addition, the protrusions may also be arranged at different intervals on the same circumference, or may also be arranged at equal or different intervals on different circumferences. Conversely to this example, it can be postulated that the motion direction converting mechanism has a configuration in which the spiral grooves are formed on the inner cylindrical surface of the rotary cylinder, and the protrusions are formed on the outer peripheral surface of the slider.

Figure 4:
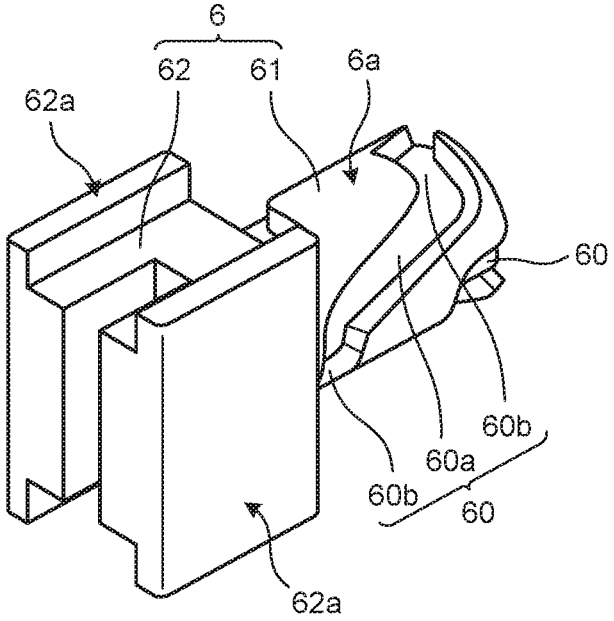
FIG. 4 is a perspective view illustrating the overall configuration of a slider.

FIG. 4 is a perspective view illustrating the overall configuration of the slider 6. As illustrated in FIG. 4, the slider 6 is configured to include a shaft portion 61 inserted into the rotary cylinder 5, and the pressing portion 62, which presses the contact portion 21 of the female terminal 2 against the male terminal 3. The shaft portion 61 has a columnar shape having a diameter slightly smaller than the inner diameter of the rotary cylinder 5 (the diameter of the inner cylindrical surface 5*a*), and the three spiral grooves 60 having the same shape are formed on the outer peripheral surface 6*a* at equal intervals and equal pitches. However, the shape or arrangement. (interval) of the spiral grooves 60 is not particularly limited as long as the spiral grooves 60 can engage with the protrusions 50. The point is that the protrusions 50 and the spiral grooves 60 may be formed in corresponding shapes and arrangements (intervals) so that they can engage with each other. In addition, the depth and width of the spiral groove 60 are set to be slightly greater than the protruding height and protruding width. (diameter) of the protrusion 50. The pressing portion 62 has a flat plate shape and is supported on the forward side of the shaft portion 61. The pressing portion 62 does nor press the contact portion 21 of the female terminal 2 against the male terminal 3 at the first cylinder axis position so as to allow the contact portion 21 to be separated from and face the male terminal 3, and presses the contact portion 21 of the female terminal 2 against the male terminal 3 at the second cylinder axis position so as to make the contact portion 21 to be electrically connected to the male terminal 3. In this embodiment, the pressing portion 62 is configured by providing two pressing flat plates 62*a* corresponding to the number of the female terminals 2 (the contact portions 21) which are pressed. The flat plate surfaces of the pressing flat plates 62*a* (surfaces that press the contact portions 21) extend with a predetermined interval (that is wider than the interval at which the two contact portions 21 face each other and is narrower than the interval at which the two contact support portions 22 face each other) therebetween in the leftward and rightward direction. In this case, the pressing portion 62 (the pressing flat plate 62*a*) is fitted in a slide groove formed in the cylinder of the terminal accommodation portion 41 of the housing and reciprocates in the cylinder axis direction along the slide groove. In addition, of the shaft portion 61 and the pressing portion 62 constituting the slider 6, at least the pressing portion 62 is formed of an insulating material such as a resin in consideration that the contact portion 21 of the female terminal 2 is pressed and is electrically connected to the male terminal 3. At this time, the shaft portion 61 may be simultaneously molded with the same insulating material as that of the pressing portion 62 integrally with the pressing portion 62. Otherwise, the shaft portion 61 may be formed of a non-insulating material such as a metallic material and may be insert-molded to the pressing portion 62.

The spiral groove 60 includes a groove (hereinafter, referred to as track groove) 60*a* which makes the protrusion 50 relatively move along the cylinder axis direction, and two restriction grooves 60*b* which are respectively provided at both ends of the track groove 60*a* to restrict the relative movement of the protrusion 50 in the cylinder axis direction. The restriction grooves 60*b* are grooves that are parallel to the circumferential direction of the rotary cylinder 5 or the slider 6 (shaft portion 61) and communicate with the end portions of the track groove 60*a*. In this case, the restriction grooves 60*b* respectively communicate with the front end portion and the rear end portion of the track groove 60*a* in the same shape as the track groove 60*a*. Accordingly, the restriction grooves 60*b* restrict further movement of the protrusion 50 that relatively moves along the track groove 60*a*. Specifically, the restriction grooves 60*b* accomplish a function as stoppers that stop the movement of the slider 6 in the cylinder axis direction with respect to the rotary cylinder 5 (that is, advance and retreat of the slider 6 in the cylinder axis direction with respect to the contact portion 21) (see FIGS. 6A and 6C). This function is performed by allowing the protrusion 50 to abut a groove wall 60*c* of the restriction groove 60*b*. In other words, the restriction grooves 60*b* function as the stoppers that restrict the movement of the protrusion 50 in the cylinder axis direction at the first cylinder axis position (the first rotation position) and the second cylinder axis position (the second rotation position). Here, the rotation position (rotation state) of the rotary cylinder 5 in a state in which the protrusion 50 engages with the restriction groove 60*b* on the rear side and the position of the slider 6 in the cylinder axis direction correspond to the first rotation position and the first cylinder axis position, and the rotation position (rotation state) of the rotary cylinder 5 in a state in which the protrusion 50 engages with the restriction groove 60*b* on the front side and the position of the slider 6 in the cylinder axis direction correspond to the second rotation position and the second cylinder axis position. Here, the groove end of the restriction groove 60*b* on the rear side is a free end, and even when the protrusion 50 is formed on the inner cylindrical surface 5*a* of the rotary cylinder 5, the slider 6 can be inserted into the cylinder of the rotary cylinder 5 from the rearward side of the shaft portion 61*a*.

The lever 10 easily rotates the rotary cylinder 5 about the cylinder axis, for example, by being gripped and moved on the outer surface of the housing 4 (the terminal accommodation portion 41). In this case, a through-hole 91 is formed in the rear cover 9, and an annular flange portion 92 is provided to protrude forward so as to surround the through-hole 91. The through-hole 91 is set to have an inner diameter slightly greater than the outer diameter of the rotary cylinder 5 such that the rear end portion of the rotary cylinder 5 can be inserted thereinto. The rear end portion of the rotary cylinder 5 is provided with a lever mounting portion 51. The lever 10 is mounted to the lever mounting portion 51 via the through-hole 91 in a state in which the rotary cylinder 5 is inserted into the through-hole 91. Accordingly, in the connector 1, by moving the lever 10 along the outer surface 41*a* of the housing 4, the rotary cylinder 5 is linked with the lever 10 and can be rotated about the cylinder axis while being guided by the flange portion 92.

The lever 10 is configured to include a gripping portion 101 which is gripped during rotation, and a support portion 102 which is mounted to the lever mounting portion 51 and supports the gripping portion 101. The gripping portion 101 extends forward from a support site supported by the support portion 102 so as to be bent along the outer surface 41*a* of the housing 4, and includes an engagement hole (not illustrated) which is formed to be engaged with any of a first locking protrusion (hereinafter, referred to as temporary locking protrusion) 43 and a second locking protrusion (hereinafter, referred to as lever locking protrusion) 44, which are formed on the outer surface 41*a* of the housing 4, in correspondence with the first rotation position and the second rotation position of the rotary cylinder 5. Accordingly, when the rotary cylinder 5 is rotated to the first rotation position, in the lever 10, the engagement hole of the gripping portion 101 is engaged with the temporary locking protrusion 43 and locked to the housing 4 such that further rotation in the reverse rotation direction is suppressed. In addition, when the rotary cylinder 5 is rotated to the second rotation position, in the lever 10, the engagement hole of the gripping portion 101 is engaged with the lever locking protrusion 44 and locked to the housing 4 such that further rotation in the forward rotation direction is suppressed. That is, the lever 10 can move between the temporary locking protrusion 43 and the lever locking protrusion 44 (in other words, between the first rotation position and the second rotation position) along the outer surface 41*a* of the housing 4. In addition, in the state in which the engagement hole of the gripping portion 101 is engaged with the lever locking protrusion 44 (the second rotation position), not only rotation of the lever 10 in the forward rotation direction but also rotation thereof in the reverse rotation direction are suppressed. At the same time, movement of the slider 6 in the cylinder axis direction is also restricted. Therefore, the state of electrical connection between the contact portion 21 of the female terminal 2 and the male terminal 3 can be reliably maintained.

Figure 5A:
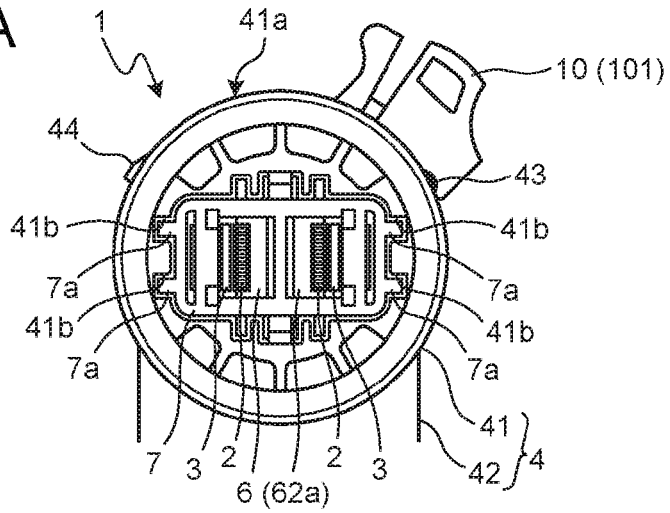
FIG. 5A is a view illustrating an operational mode of an operation member, and is a view illustrating a state in which the operation member is locked to a housing at a position corresponding to a first rotation position
Figure 5B:
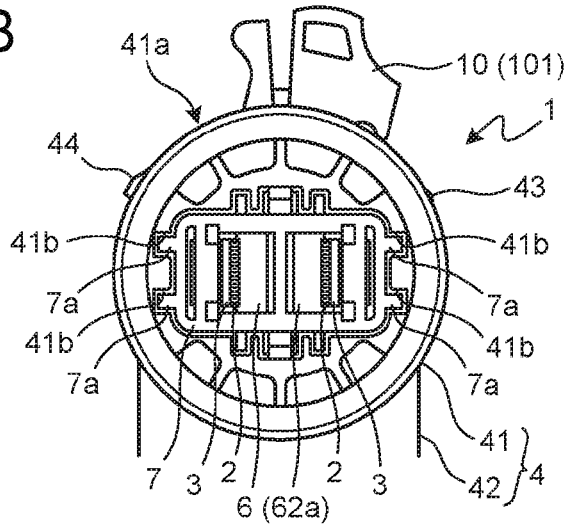
FIG. 5B is a view illustrating an operational mode of an operation member, and is a view illustrating a state in which the operation member is moved between positions corresponding to the first rotation position and a second rotation position.
Figure 5C:
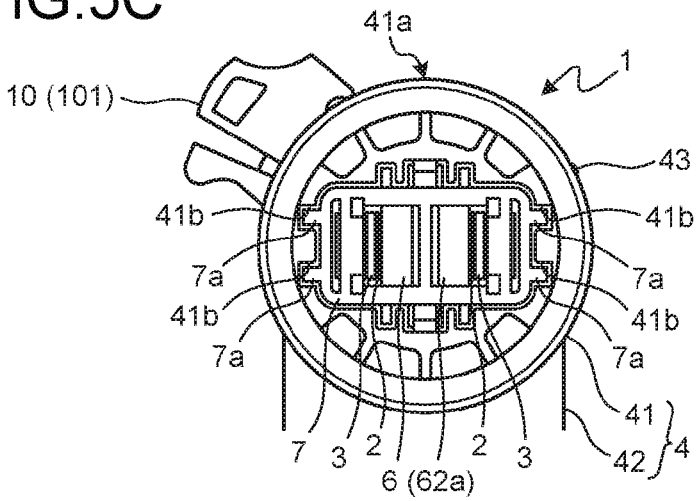
FIG. 5C is a view illustrating an operational mode of an operation member, and is a view illustrating a state in which the operation member is locked to the housing at a position corresponding to the second rotation position.
Figure 6A:
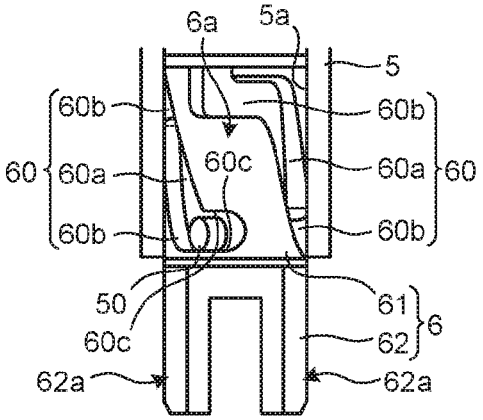
FIG. 6A is a view illustrating the positional relationship between the rotary cylinder and the slider, and is a mechanism diagram illustrating a state in which the rotary cylinder is rotated to the first rotation position.
Figure 6B:
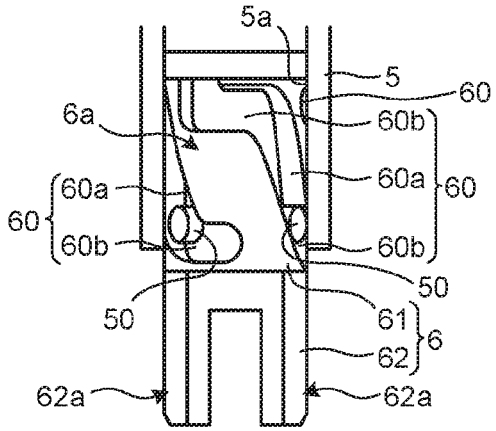
FIG. 6B is a view illustrating the positional relationship between the rotary cylinder and the slider, and is a mechanism diagram illustrating a state in which the rotary cylinder is rotated between the first rotation position and the second rotation position.
Figure 6C:
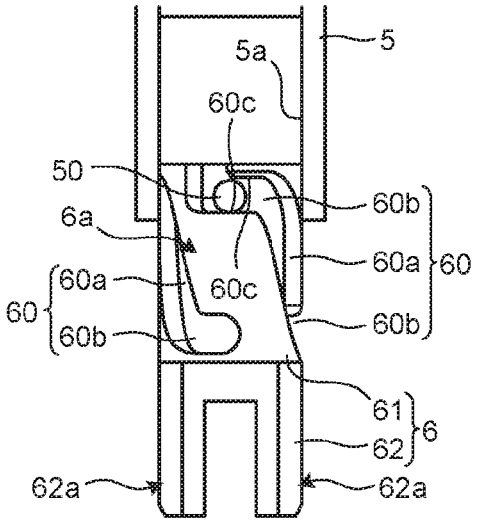
FIG. 6C is a view illustrating the positional relationship between the rotary cylinder and the slider, and is a mechanism diagram illustrating a state in which the rotary cylinder is rotated to the second rotation position.
Figure 7A:
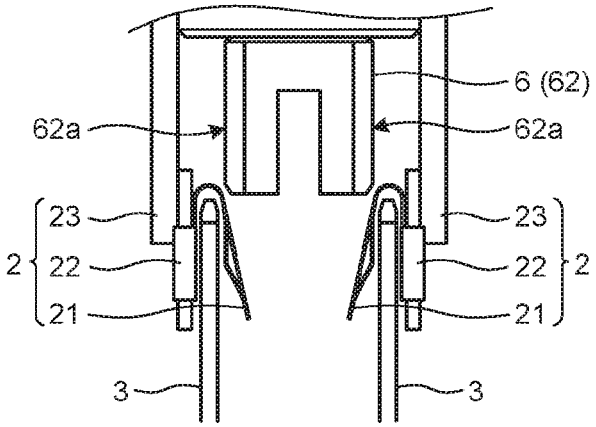
FIG. 7A is a view illustrating the positional relationship between a female terminal and a male terminal, and is a mechanism diagram illustrating a state in which the male terminal is inserted into the housing and faces the female terminal.
Figure 7B:
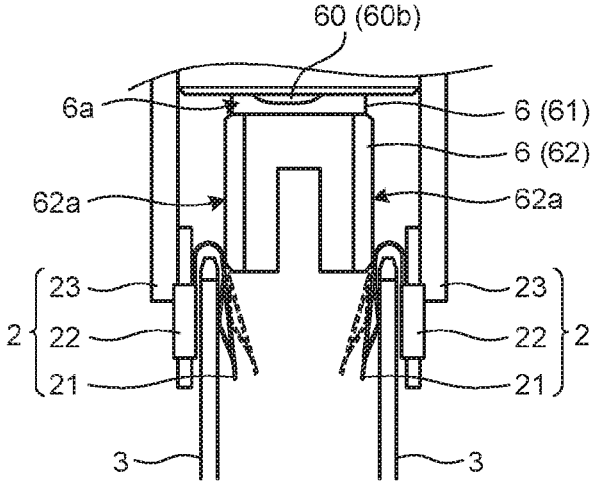
FIG. 7B is a view illustrating the positional relationship between the female terminal and the male terminal, and is a mechanism diagram illustrating a state in which the female terminal is started to be pressed against the male terminal by the slider.
Figure 7C:
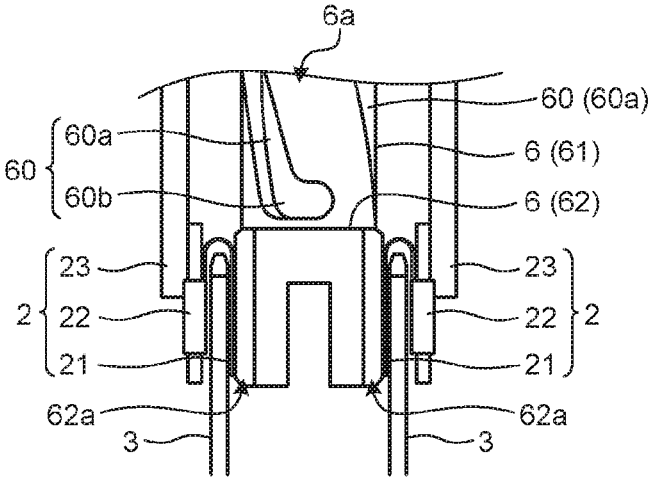
FIG. 7C is a view illustrating the positional relationship between the female terminal and the male terminal, and is a mechanism diagram illustrating a state in which the female terminal and the male terminal are electrically connected to each other.

Here, in the connector 1 according to this embodiment, the operations of the rotary cylinder 5, the slider 6, and the lever 10 when the female terminal 2 and the male terminal 3 are electrically connected to each other will be described with reference to FIGS. 5 to 7. FIGS. 5A to 5C illustrate operational modes of the lever 10 from the forward side of the connector 1. FIG. 5A is a view illustrating a state in which the lever 10 is locked to the temporary locking protrusion 43 (hereinafter, the position in this state is referred to as "lever OFF position"). FIG. 5B is a view illustrating a state in which the lever 10 is moved between the temporary locking protrusion 43 and the lever locking protrusion 44 (hereinafter, this state is referred to as "lever operation"). FIG. 5C is a view illustrating a state in which the lever 10 is locked to the lever locking protrusion 44 (hereinafter, the position in this state is referred to as "lever ON position"). In addition, FIGS. 6A to 6C illustrate the positional relationship between the rotary cylinder 5 and the slider 6. FIG. 6A is a mechanism diagram illustrating a state in which the rotary cylinder 5 is rotated to the first rotation position. FIG. 6B is a mechanism diagram illustrating a state in which the rotary cylinder 5 is rotated between the first rotation position and the second rotation position. FIG. 6C is a mechanism diagram illustrating a state in which the rotary cylinder 5 is rotated to the second rotation position. In addition, FIGS. 7A to 7C illustrate the positional relationship between the female terminal 2 and the male terminal 3. FIG. 7A is a mechanism diagram illustrating a state in which the male terminal 3 is inserted into the housing 4 and faces the female terminal 2 (a state in which the slider 6 is at the first cylinder axis position). FIG. 7B is a mechanism diagram illustrating a state in which the female terminal 2 is started to be pressed against the male terminal 3 by the slider 6. FIG. 7C is a mechanism diagram illustrating a state in which the female terminal 2 and the male terminal 3 are electrically connected to each other (a state in which the slider 6 is at the second cylinder axis position). In addition, the states illustrated in FIGS. 5A, 6A, and 7A correspond to each other (synchronized). Similarly, each of the states of FIGS. 5B, 6B, and 7B, and the states of FIGS. 5C, 6C, and 7C correspond to each other (synchronized).

First, in order to allow the mating device having the male terminal 3 to be fitted with the connector 1, the lever 10 is positioned at the lever OFF position (the position illustrated in FIG. 5A). At the lever OFF position, the engagement hole is engaged with the temporary locking protrusion 43, and the rotation of the lever 10 in the reverse rotation direction with respect to the housing 4 (the rightward direction in FIG. 5A) is suppressed. In this state, as illustrated in FIG. 6A, the protrusion 50 engages with the restriction groove 60*b* on the front side (lower side in the figure) between the rotary cylinder 5 and the slider 6 and the slider 6 is positioned at the innermost position in the cylinder of the rotary cylinder 5 (the rearmost slide with respect to the forward and rearward directions), that is, positioned at the first cylinder axis position such that the movement of the slider 6 in the cylinder axis direction (the forward and rearward directions) with respect to the rotary cylinder 5 is restricted. In addition, as illustrated in FIG. 7A, when the male terminal 3 is inserted into the housing 4 (terminal holder 7) in this state, the inserted male terminal 3 is positioned in the gap between the contact portion 21 and the contact support portion 22 and faces the contact portion 21 of the female terminal 2 without contacts. At this time, the pressing portion 62 of the slider 6 also does not come into contact with the contact portion 21. Therefore, the contact portion 21 of the female terminal 2 is in an open state.

At the lever OFF position, when a rotational force is exerted on the lever 10 in the forward rotation direction (the leftward direction in FIG. 5A) against the force of engagement between the engagement hole and the temporary locking protrusion 43, the engagement between the engagement hole and the temporary locking protrusion 43 is released and the lever 10 can be rotated forward with respect to the housing 4. Accordingly, the lever 10 is transited to the lever operation state as illustrated in FIG. 5B. During the lever operation, as illustrated in FIG. 6B, the protrusion 50 moves in the circumferential direction along the restriction groove 60*b*, enters the track groove 60*a*, and relatively moves along the track groove 60*a*. As a result, the slider 6 is extruded toward the front side with respect to the rotary cylinder 5 and advances toward the contact portion 21 of the female terminal 2. In addition, as illustrated in FIG. 7B, in the slider 6 that advances toward the contact portion 21, the pressing flat plate 62*a* of the pressing portion 62 comes into contact with the contact portion 21 at the support site supported by the contact support portion 22, and the pressing flat plate 62*a* presses and elastically deforms the contact portion 21 (bending deformation). Accordingly, the contact portion 21 is started to be bent toward the male terminal 3.

When the lever 10 is rotated forward with respect to the housing 4 and is moved to the lever ON position (the position illustrated in FIG. 5C), the engagement hole is engaged with the lever locking protrusion 44 such that the rotation of the lever 10 in the forward rotation direction (the leftward direction in FIG. 5C) with respect to the housing 4 is suppressed. At this time, the protrusion 50 further relatively moves along the track groove 60*a* and the slider 6 is further extruded toward the front side in the cylinder axis direction with respect to the rotary cylinder 5. As a result, as illustrated in FIG. 6C, the protrusion 50 engages with the restriction groove 60*b* on the rear side (upper side in the figure) between the rotary cylinder 5 and the slider 6 and the slider 6 is positioned at the foremost position in the cylinder of the rotary cylinder 5 (the foremost slide with respect to the forward and rearward directions), that is, positioned at the second cylinder axis position such that the movement of the slider 6 in the cylinder axis direction. (the forward and rearward directions) with respect to the rotary cylinder 5 is restricted. In addition, the slider 6 further advances while the pressing flat plate 62*a* of the pressing portion 62 which comes into contact with the contact portion 21 presses the contact portion 21, and as illustrated in FIG. 7C, the pressing flat plate 62*a* allows the contact portion 21 to be completely bent. Specifically, the two pressing flat plates 62*a* advance forward in the cylinder axis direction while respectively pressing the two contact portions 21 to cause the contact portions 21 to be separated from each other, and elastically deform and bend the corresponding contact portions 21 toward the male terminals 3 which are respectively positioned in the gaps between the contact portions 21 and the contact support portions 22 until the contact portions 21 come into contact with the male terminals 3. Both of the two pressing flat plates 62*a* form a flat plate shape, and the flat plate surfaces (pressing surfaces) extend with an interval therebetween in the leftward and rightward direction to correspond to the interval at which the two contact portions 21 face each other. Therefore, the pressing flat plates 62*a* can reliably press the two contact portions 21 against the corresponding male terminals 3 and allow the two contact portions 21 to smoothly come into contact with the corresponding male terminals 3. Accordingly, in the connector 1, it is possible to electrically connect the female terminal 2 and the male terminal 3 to each other.

In addition, in the connector 1, when a rotational force is exerted on the lever 10 from the lever ON position in the reverse rotation direction (the rightward direction in FIG. 5C) against the force of engagement between the engagement hole and the temporary locking protrusion 44 and the lever 10 is moved to the lever OFF position, the slider 6 can be allowed to retreat toward the rear side in the cylinder axis direction with respect to the rotary cylinder 5. Accordingly, in the connector 1, the pressing flat plate 62*a* of the pressing portion 62 is separated from the contact portion 21 and the pressure is released such that the electrical connection between the female terminal 2 and the male terminal 3 is released. In addition, in this state, since the male terminal 3 is held in the terminal holder 7 while facing the contact portion 21 of the female terminal 2 without contacts, the male terminal 3 can be easily drawn from the housing 4, that is, the fitting of the mating device having the male terminal 3 and the connector 1 can be easily released.

As described above, according to this embodiment, in the stage of insertion into the housing 4, the insertion load of the male terminal 3 can be reduced, and only by moving the lever 10, the female terminal 2 can be electrically connected to the male terminal 3 with ease. At this time, since the lever 10 moves on an arc-shaped path along the outer surface 41*a* of the housing 4, in the connector 1, the movement distance can be ensured while achieving a reduction in the size of the connector 1, compared to linear movement of the lever 10. In another point of view, the connector 1 may rotate the rotary cylinder 5 about the cylinder axis between the first rotation position and the second rotation position in order to electrically connect the female terminal 2 to the male terminal 3. Therefore, a linear movement distance in a direction perpendicular to the insertion direction (corresponding to the cylinder axis direction) of the male terminal 3 does not need to be ensured. Therefore, in the connector 1, there is no need to ensure a large space for mounting the connector 1 on an electric device in the perpendicular direction, and thus space saving can be achieved. That is, according to the connector 1 according to this embodiment, a reduction in the insertion load of the male terminal 3 and a reduction in the size are simultaneously achieved. Therefore, mountability on a device can be increased.

While the present invention has been described based on the embodiment illustrated in FIGS. 1 to 7C, the above-described embodiment is merely an example of the present invention, and the present invention is not limited only to the configuration of the above-described embodiment. Therefore, it should be noted by those skilled in the arts that the present invention can be embodied in a modified or changed form in the scope of the gist of the present invention, and it is natural that such a modified and changed form belongs to the appended claims.

The connector according to the present invention simultaneously can achieve a reduction in a terminal insertion load and a reduction in size, and increase mountability on a device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a female terminal having an elastically deformable contact portion;

a housing in which the female terminal is accommodated;

a rotary cylinder configured to be rotatably mounted to the housing; and a slider configured to be movably mounted in a cylinder axis direction of the rotary cylinder via a motion direction converting mechanism which converts rotary motion of the rotary cylinder about a cylinder axis into linear motion in the cylinder axis direction of the rotary cylinder, wherein the motion direction converting mechanism is configured to move the slider from a first cylinder axis position to a second cylinder axis position when the rotary cylinder is rotated from a first rotation position to a second rotation position, the slider is formed to be separated from the contact portion of the female terminal at the first cylinder axis position and is formed to press the contact portion of the female terminal at the second cylinder axis position, and the contact portion of the female terminal is positioned to face the male terminal inserted into the housing and is formed to come into pressing contact with the male terminal by being pressed by the slider.

2. The connector according to claim 1, wherein as the motion direction converting mechanism, at least one protrusion is formed on one of an inner cylindrical surface of the rotary cylinder and an outer peripheral surface of the slider, and at least one spiral groove configured to engage with the protrusion is formed on the other, when the rotary cylinder is rotated about the cylinder axis from the first rotation position to the second rotation position, the protrusion relatively moves along the spiral groove to make the slider to move from the first cylinder axis position to the second cylinder axis position, and when the rotary cylinder is rotated about the cylinder axis from the second rotation position to the first rotation position, the protrusion relatively moves along the spiral groove to make the slider to retreat from the second cylinder axis position to the first cylinder axis position.

3. The connector according to claim 2, wherein the spiral groove includes a track groove in which the protrusion relatively moves along the cylinder axis direction, and two restriction grooves which are respectively provided at both ends of the track groove to restrict the relative movement of the protrusion in the cylinder axis direction, and the restriction grooves are grooves that are parallel to a circumferential direction of the rotary cylinder or the slider and communicate with end portions of the track groove.

4. The connector according to claim 1, further comprising:

an operation member configured to be mounted on the rotary cylinder and move along an outer surface of the housing to rotate the rotary cylinder about the cylinder axis.

5. The connector according to claim 2, further comprising:

an operation member configured to be mounted on the rotary cylinder and move along an outer surface of the housing to rotate the rotary cylinder about the cylinder axis.

6. The connector according to claim 3, further comprising:

an operation member configured to be mounted on the rotary cylinder and move along an outer surface of the housing to rotate the rotary cylinder about the cylinder axis.

* * * * *